United States Patent [19]

Ranft et al.

[11] Patent Number: 4,473,123

[45] Date of Patent: Sep. 25, 1984

[54] DIESEL HAMMER CAPABLE OF DELIVERING UPLIFT BLOWS AND METHOD OF USING SAME

[75] Inventors: Eberhard V. Ranft, Houston, Tex.; Robert L. Vincent, Matthews, N.C.

[73] Assignee: Raymond International Builders, Inc., Houston, Tex.

[21] Appl. No.: 405,615

[22] Filed: Aug. 5, 1982

[51] Int. Cl.[3] ..... B25D 9/00

[52] U.S. Cl. ..... 173/91; 173/1; 173/134

[58] Field of Search ..... 173/1, 91, 127, 131, 173/114, 116, 133, 178, 134

[56] References Cited

U.S. PATENT DOCUMENTS

| | | | |
|---|---|---|---|
| 1,102,652 | 7/1914 | Gibb et al. | 61/76 |
| 1,292,429 | 1/1919 | Bull . | |
| 1,566,631 | 12/1925 | Sturtevant | 173/91 |
| 2,951,345 | 9/1960 | Lang | 61/76 |
| 3,109,500 | 11/1963 | Glawon | 173/127 |
| 3,283,832 | 11/1966 | Spannhake et al. | 173/126 |
| 3,474,870 | 10/1967 | Cook | 173/91 |
| 3,511,325 | 5/1970 | Schmidt | 173/131 |
| 3,583,499 | 6/1971 | Cordes | 173/131 |
| 3,815,373 | 6/1974 | Giroux | 61/53.5 |
| 3,920,083 | 11/1975 | Makita | 173/49 |
| 4,131,164 | 12/1978 | Hague et al. | 173/1 |
| 4,159,039 | 6/1979 | Kasuga et al. | 173/1 |

OTHER PUBLICATIONS

"Model 520 Diesel Pile Hammer"-1 p. advertisement of International Construction Equipment Inc.

*Primary Examiner*—E. R. Kazenske
*Assistant Examiner*—Willmon Fridie
*Attorney, Agent, or Firm*—Fitzpatrick, Cella, Harper & Scinto

[57] ABSTRACT

A diesel hammer (20) is adapted to produce uplift blows by connecting its casing (30) via a pulling connection (52) to a case (24) to be pulled, removing vent plugs (76) from the top of the casing, sealing all other openings (78), (82), (94), in the casing, applying compressed air from an external source (106) under the hammer ram (32) to drive it upwardly and thereafter allowing controlled flow of air out of the casing via a bleed line (118) and an adjustable orifice (238) to cushion the subsequent fall of the ram.

16 Claims, 21 Drawing Figures

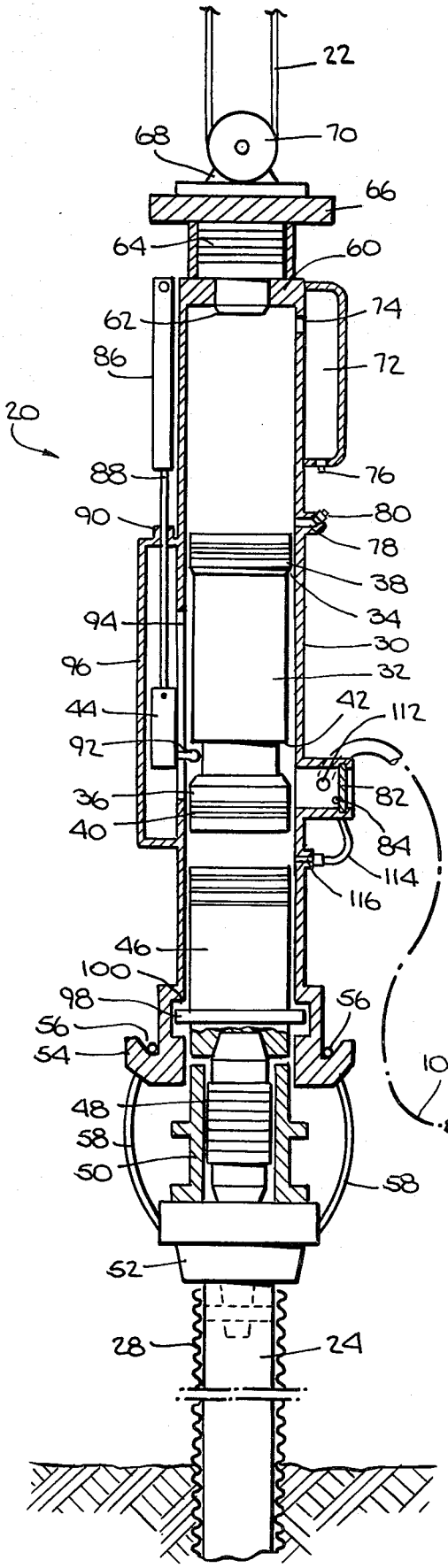
Fig. 2.
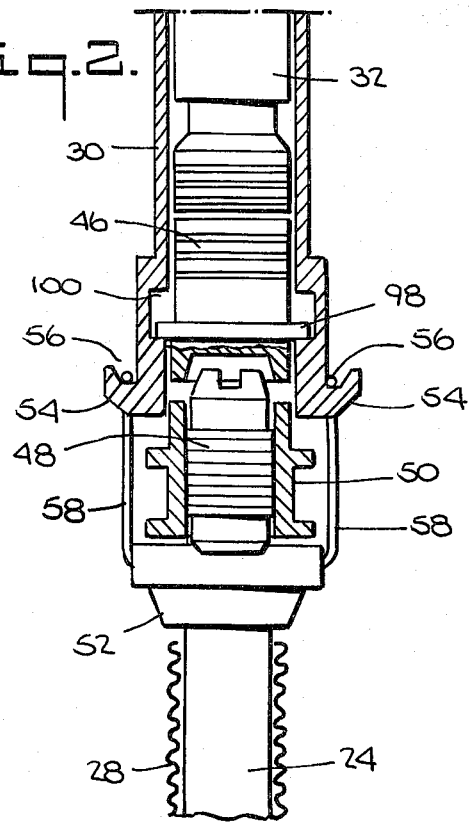
Fig. 1.
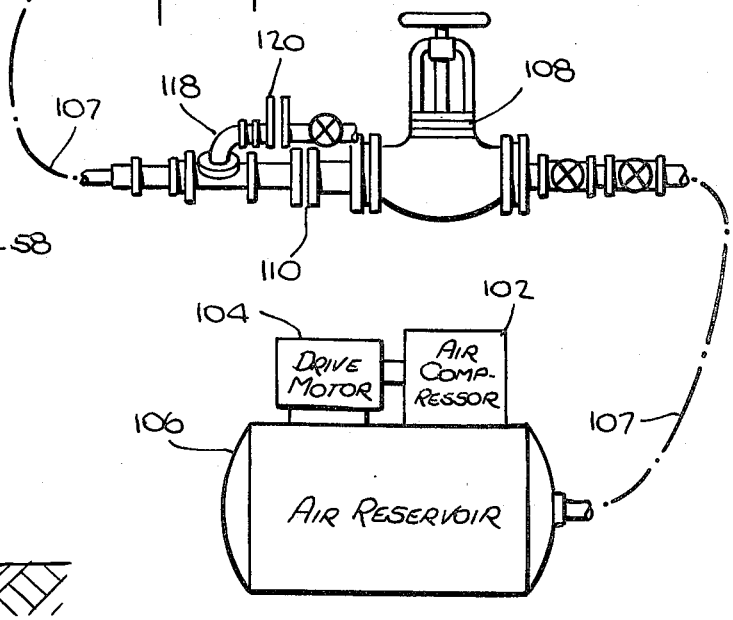

136
168
66
168
136
168
136
136
134
134
176
178
172
174
172
168
134
176
180
178
30
86
130
130
130
130
132
30
132
132
170
170
54
56
132

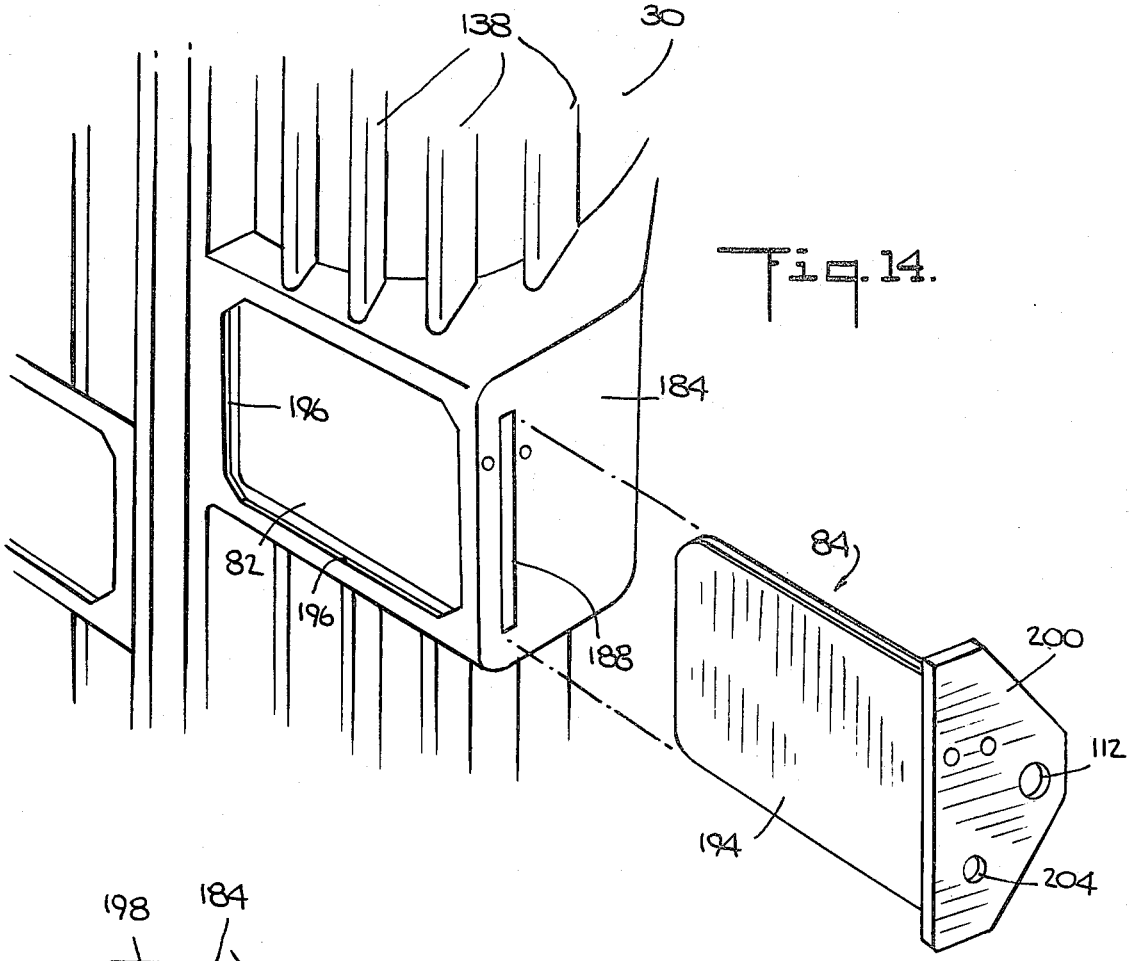
Fig. 14.
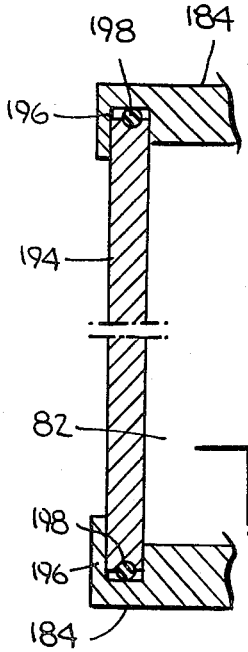
Fig. 16.
Fig. 15.
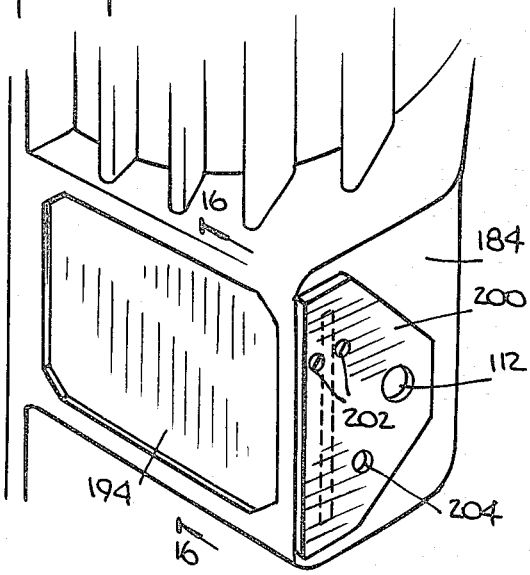

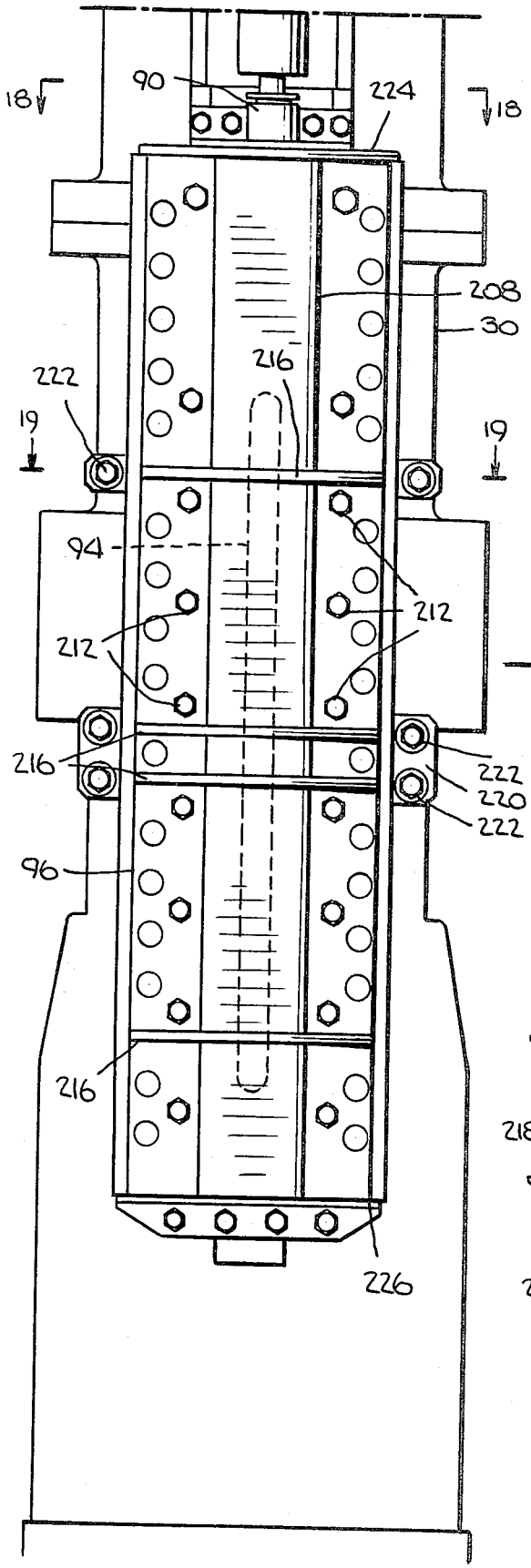
Fig. 17.
Fig. 18.
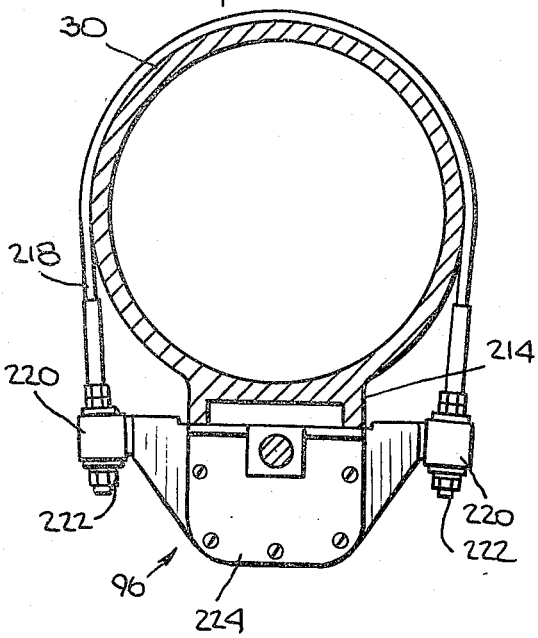
Fig. 19.
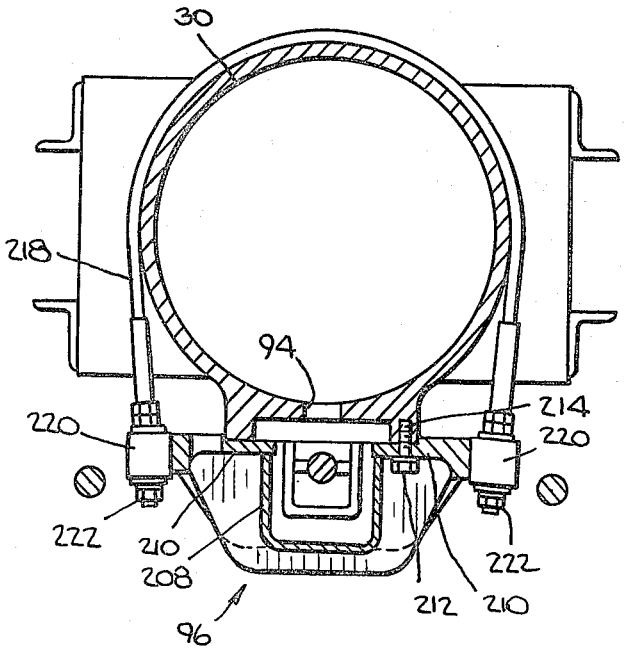

DIESEL HAMMER CAPABLE OF DELIVERING UPLIFT BLOWS AND METHOD OF USING SAME

CROSS REFERENCE TO RELATED APPLICATION

This application contains subject matter related to U.S. patent application Ser. No. 489,572, filed Apr. 28, 1983.

BACKGROUND OF THE INVENTION

1. Field of the Invention

This invention relates to pile driving hammers and in particular it concerns a novel diesel type pile driving hammer which is also capable of applying uplift blows as well as to a novel method for use of such hammer.

2. Description of the Prior Art

Diesel type pile driving hammers are well known in the construction industry. One example is the Model 520 Diesel Pile Hammer supplied by International Construction Equipment, Inc., 301 Warehouse Dr., Matthews, N.C. In a typical diesel hammer, a heavy ram falls in a cylinder onto an anvil mounted on the top of a pile. The impact of the ram on the anvil drives the pile down. During the fall of the ram, the air under the ram is compressed into one or more pockets formed in the upper surface of the anvil. At the time the ram strikes the anvil fuel is admitted to the pockets and mixes with the compressed air and explodes to drive the ram up for another stroke.

During the rise and subsequent fall of the ram, it passes by exhaust and inlet ports in the cylinder to allow discharge of the products of combustion and admission of fresh air to be compressed.

From time to time, in pile driving work, it becomes necessary to apply uplift blows to extract an object that has been driven. For example, some piles are installed by inserting a thick wall mandrel inside a thin walled tubular shell and driving on the mandrel to force the shell into the earth. The mandrel is thereafter extracted so that the shell, which remains in the ground, can be filled with concrete. During the driving operation the shell occasionally becomes squeezed against the mandrel, making the mandrel difficult to withdraw. When the mandrel has been hammered down with an air, steam or hydraulically driven hammer, the hammer is readily converted to uplift blow or "BUMPOUT" operation simply by reversing the controls or by turning the hammer upside down. Examples of such reversible hydraulic hammers are shown in U.S. Pat. Nos. 1,102,652, 1,292,429, 3,474,870, 3,583,499, 3,511,325 and U.S. Pat. No. Re. 28,151. There have also been disclosed reversible vibratory pile driving and extracting devices such as shown for example in U.S. Pat. No. 3,920,083. According to that patent the vibratory frequency is chosen to coincide with the resiliency and weight or force of the pile system during driving or extraction. There has also been proposed, in U.S. Pat. No. 4,159,039, a pile driving and extracting arrangement which makes use of the storage and selective release of strain energy in a deformable member to apply driving or extraction forces to the pile.

It has also been proposed to use diesel type hammers which are designed exclusively for generating uplift blows. Examples of such hammers are shown in U.S. Pat. No. 2,951,345 to A. Lang and in U.S. Pat. No. 3,109,500 to P. Glawon. The Lang hammer is actually a downward ramming hammer with a hydraulic motion reversing device. The Glawon hammer is a diesel hammer turned upside down. In both these diesel hammer arrangements there is produced a downward reaction which is substantially as great as the upward blow and which detracts from the ability of the hammer to extract the mandrel or other element to which it is connected. Also, neither the Lang or Glawon devices are designed to produce downward hammering blows.

SUMMARY OF THE INVENTION

The present invention avoids the above discussed disadvantages of the prior art and provides a novel diesel hammer construction which is capable of producing controlled uplift blows without corresponding downward reactions so that an object, such as a mandrel, can be extracted quickly and efficiently.

According to one aspect of the invention, a diesel hammer, which otherwise operates to produce downward hammer blows in the normal fashion, is adapted to produce upward blows by means of a pulling connection at the lower end of the hammer to pull up on the upper end of the element to be extracted, an upper anvil at the upper end of the hammer casing to receive blows from the upper end of the hammer ram, a vent in the upper end of the casing to permit free upward movement of the ram, means to throw the ram upwardly in the casing to strike the upper anvil and a cushion forming construction arranged to cushion the downward movement of the ram following impact of the ram against the upper anvil.

In the preferred embodiment of the invention the means to throw the ram upwardly in the casing comprises a source of compressed air, an air line and valve arranged to direct the compressed air into the hammer casing under the ram and closure elements positioned to close openings in the hammer casing such as the air inlet and exhaust openings and, where a starting latch slot is provided in the casing, also to close the starting slot. Furthermore, in the preferred embodiment, the cushion forming construction comprises the provision of a bleed line and valve connected near the bottom of the hammer casing to allow air trapped under the ram to exhaust from the casing at a controlled rate.

According to another aspect of the invention there is provided a novel method of using a diesel hammer to deliver uplift blows. This novel method comprises the steps of connecting the hammer casing to an object which is to receive the uplift blows, venting the top of the casing to permit free upward movement of the hammer ram, sealing all other openings in the casing, applying a pressurized gas under the ram in the casing to drive the ram upwardly to strike against the top of the casing and thereafter cushioning the subsequent fall of the ram by permitting the gas under the ram to escape from the casing at a controlled rate.

There has thus been outlined rather broadly the more important features of the invention in order that the detailed description that follows may be better understood, and in order that the present contribution to the art may be better appreciated. There are, of course, additional features of the invention that will be described more fully hereinafter. Those skilled in the art will appreciate that the conception on which this disclosure is based may readily be utilized as the basis for the designing of other arrangements for carrying out the several purposes of the invention. It is important, therefore, that the disclosure be regarded as including such other arrangements and do not depart from the spirit and scope of the invention.

BRIEF DESCRIPTION OF THE DRAWINGS

A preferred embodiment of the invention has been chosen for purposes of illustration and description, and is shown in the accompanying drawings, forming a part of the specification wherein:

FIG. 1 is a side elevational section view showing the interior of a diesel hammer arranged according to the present invention to provide bumpout capability;

FIG. 2 is a fragmentary view showing the lower portion of the hammer of FIG. 1 as suspended for bumpout operation;

FIG. 14 is an enlarged fragmentary perspective view showing the exhaust port of the hammer of FIG. 1 about to receive a closure for converting the hammer to bumpout operation according to the invention;

FIG. 15 is a view similar to FIG. 14, showing the closure plate in place;

FIG. 16 is a view taken along line 16—16 of FIG. 15;

FIG. 17 is an elevational view of the exterior of the diesel hammer of FIG. 1 showing a starting slot closure used for converting the hammer to bumpout operation according to the invention;

FIG. 18 is a view taken along line 18—18 of FIG. 17;

FIG. 19 is a view taken along line 19—19 of FIG. 17;

Figure 3:
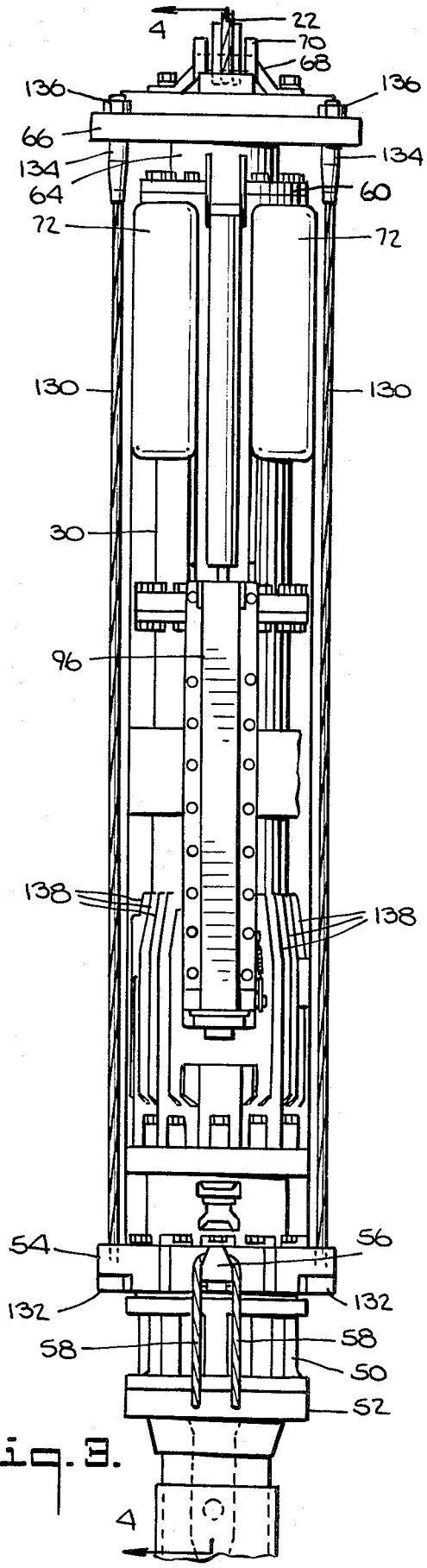
FIG. 3 is a side elevational view showing the exterior of the diesel hammer of FIG. 1.

A prototype of the invention, made by modification of an ICE Model 520 Diesel Hammer as described herein, has been built and successfully tested.

DETAILED DESCRIPTION OF THE PREFERRED EMBODIMENT

As shown in FIG. 1 a diesel hammer, indicated generally as 20, is connected at its upper end to a suspension cable 22 which extends down from a crane (not shown); and the hammer is attached at its lower end to a mandrel or core 24 which is driven by the hammer into the earth 26.

In the application shown, the mandrel or core is made of heavy wall pipe and it fits closely inside a thin wall corrugated shell 28 having a heavy boot plate or cover (not shown) at its lower end. The shell 28 is too fragile to be driven down into the earth but when the heavy wall core 24 is inside the shell, hammer blows can be applied to the upper end of the core and the core and shell can be driven down together. After the core and shell have been driven to a desired depth the core is pulled out and the shell if filled with concrete to form a cast in place pile.

It often happens during the driving of a core and shell assembly, as above described, that pressures exerted by the surrounding soil or rocks or other debris in the soil will indent the shell 28 and cause it to squeeze against the core 24 at one or more places along its length. As a result, the core cannot be pulled out except by upward hammering. The diesel hammer construction of FIG. 1 accomplishes this upward hammering.

As can be seen in FIG. 1 the hammer 20 comprises an outer tubular casing 30 which contains a massive ram 32 mounted for up and down movement in the casing. The ram has larger diameter portions 34 and 36 at its upper and lower ends which fit closely but are freely slideable inside the casing 30 to guide the ram for its up and down movement. Upper and lower piston rings 38 and 40 are mounted on the larger diameter portions of the ram 32. These rings contact the casing wall and provide a pressure seal between the ram and the casing. The ram 32 also has an annular starting latch recess 42 which is engaged by starting latch mechanism 44 as will be explained more fully hereinafter. During normal operation the starting latch mechanism 44 is retracted away from the ram and the ram is free to move up and down in the casing.

Near the bottom of the casing 30 and under the ram 32 there is provided an anvil 46. This anvil is arranged to receive blows from the ram 32 when it drops down through the casing. The anvil in turn rests on a cap block 48 of well known construction and this cap block in turn extends through a cap block casing 50 and rests on the upper end of the core 24. The core 24 is also connected to the hammer via a pulling connection 52 to be described hereinafter. The lower end of the casing 30 is formed with a base adaptor 54 having external grooves 56 which support core slings 58. The core slings extend down from the base adaptor to the pulling connection 52 to hold it up against the casing.

The upper end of the casing 30 is covered with a casing cover 60 and an upper anvil 62 which extends through the casing cover 60 and into the upper end of the casing. An upper cap block 64 of similar construction to the cap block 48 is provided above the upper anvil and a head adaptor 66 is arranged above the upper cap block. A pulley support 68 and a pulley 70 are mounted on the head adaptor 66 and the suspension cable 22 passes through the pulley for lifting the entire hammer assembly.

A bounce chamber 72 is mounted outside the casing 30 near its upper end and communicates with the interior of the casing via bounce chamber ports 74. There are also provided removable vent plugs 76 of the bottom of the bounce chamber 72.

Pressure equalizer vents 78 are arranged in the casing just above the ram 32 in its lower position in the casing and vent covers 80 are provided to cover these vents during bumpout operation.

As shown in FIG. 1 there is provided a large air inlet port 82 in the casing 30 a short distance above the anvil 46. In normal diesel operation the air inlet port 82 is open to the atmosphere but for bumpout operation according to the invention an air inlet port shutter 84 closes the port. An exhaust port (not shown in FIG. 1) is also provided near the air inlet port and it also is closed with a shutter for bumpout operation.

A hydraulic starting piston and cylinder assembly 86 is mounted outside the casing 30 near its upper end. Hydraulic supply lines and a hydraulic control system (not shown) are also provided to actuate the piston and cylinder assembly. A piston rod 88 extends down from the piston and cylinder assembly 86 and through a packing gland 90 to the starting latch mechanism 44. A latch element 92 on the latch mechanism extends through a starting slot 94 in the casing and engages the ram 32 in the latch recess 42. The starting slot 94, the latch mechanism 44 and the lower end of the piston rod 88 are enclosed in a starting slot cover 96 mounted on the casing 30.

The lower end of the anvil 46 is formed with a flange 98 which extends into an annular groove formed 100 in the base adaptor 54. The height of the groove 100 is greater than the thickness of the anvil flange 98. When the hammer is used to apply downward hammer blows to the core 24 the suspension cable 22 is loosened to bring the weight of the hammer 20 down on the core. As shown in FIG. 1 the core slings 58 become slack and the cap block 48, which rests on top of the core 24 pushes up against the bottom of the anvil 46 and the upper side of the anvil flange 98 comes into contact with the upper surface of the groove 100 in the base adaptor 54. In this case, ram blows on the anvil 46 are transmitted directly through the anvil and the cap block 48 to the top of the core 24.

When the hammer is used to apply bumpout or uplift blows the suspension cable 22 is tightened to pull upwardly on the hammer. this causes the base adaptor to be lifted and the core slings 58 to tighten and pull upwardly on the pulling connection 52 as shown in FIG. 2. As can be seen, the lower surface of the groove 100 in the base adaptor engages the bottom of the anvil flange 98 to lift the anvil off from the cap block 48. In this case upward blows applied to the upper anvil 62 are transmitted via the base adaptor 54, the core sling 58 and the pulling connection 52 to the upper end of the core 24.

For uplift operation there is provided, as shown in FIG. 1., an air compressor 102 driven by a suitable drive motor 104. The air compressor output is supplied to an air reservoir 106 which is connected, via an air supply line 107, a pressure reducing valve 108 and a quick opening valve 110 to an air supply opening 112 in the air inlet port 82 inside the shutter 84. A small diameter auxiliary air line 114 extends down from the air inlet port 82 down to an auxiliary air inlet 116 which extends through the casing wall just above the anvil 46 when the hammer is suspended for uplift blows as shown in FIG. 2. A bleed line 118 branches off from the air supply hose and a bleed valve 120 is arranged in the bleed line.

For downward hammering operations there are also provided fuel injector mechanisms and diesel fuel inlets (not shown) in the casing 30 at the top of the anvil 44.

The construction of the diesel hammer shown in FIG. 1 is based upon the construction of the well known ICE Model 520 Diesel Hammer. The modifications to that hammer which adapt it for bumpout operation are as follows:

1. The air inlet and exhaust ports are covered with shutters, such as the air inlet port shutter 84;
2. The starting slot 94 is covered by means of the starting slot cover 94;
3. The equalizer vents 78 are closed by means of the vent cover 80;
4. The removable vent plugs 76 are removed from the bounce chamber 72;
5. The air supply hose 107 from the air reservoir 106 is connected to the air supply opening 112 and the auxiliary air line 114 is connected between the air inlet port 82 and the auxiliary air inlet 116.

Operation of the hammer in its conventional hammer mode will now be described. For operation in this mode, the air inlet and exhaust ports are opened and the auxiliary air inlet 116 is closed. Also the vent covers 80 are removed from the equalizer vents 78 and the vent plugs 76 are inserted in place in the bounce chamber 72.

The hammer is started by actuation of the hydraulic starting piston and cylinder assembly 86. This causes the piston rod 88 to pull up on the latch mechanism 44; and the latch element 92 which projects through the starting slot 94 engages the ram 32 in the recess 42. This causes the ram to be lifted up in the casing 30. When the ram reaches a predetermined height the latch mechanism 44 trips and the latch element 92 releases the ram to let it fall in the casing. The specific construction of the latch mechanism does not form part of the invention and since it is a well known device its specific construction will not be described herein. As the ram 32 falls it pushes air under it out through the air inlet port 82 and the exhaust port. However, when the lower end of the ram passes these ports, the air trapped under the ram becomes compressed and its temperature increases. Just as the ram 32 hits the top of the anvil 46, diesel fuel is injected into a pocket in the top of the anvil where the heated compressed air collects, and the fuel-air mixture explodes to drive the ram up in the casing. As the ram passes the exhaust port the combustion products are allowed to escape. Also, continued upward movement of the ram draws fresh air in through the air inlet port 82. During the upward movement of the ram the air above its upper end is compressed in the upper end of the casing 30 and in the bounce chamber 72. As a result the air acts as a spring to store energy received from the upward movement of the ram. When the ram reaches the top of its stroke, prior to contact with the upper anvil 62, the compressed air reexpands to help drive the ram downward. This reexpansion of air above the ram plus the weight of the ram cause it to fall rapidly and hit the top of the anvil 46 with great force to drive the core 24 and the shell 28 downwardly. Also, as in the case of starting the hammer, the air under the ram becomes compressed after the lower end of the ram passes the air inlet and exhaust ports and, just as the ram hits the anvil, a new charge of diesel fuel is injected into the pocket of compressed air at the top of the anvil to produce another explosion and drive the ram up once again. It will be appreciated that this operation is self sustaining and the starting latch mechanism is no longer needed. After each blow any residual positive or negative air pressure above the ram is equalized to the ambient atmospheric pressure via the open equalizer vent 78. It will be appreciated that as soon as the ram begins its upward movement its upper end passes this vent and traps the air above the ram so that it can be compressed in the upper portion of the casing 30 and in the bounce chamber 72 as above described.

The above described diesel hammering operation is well known and does not per se constitute the invention. Operation of the diesel hammer converted for bumpout or upward blow operation according to the invention will now be described. For converting the hammer to bumpout operation the suspension cable 22 is tightened to lift the hammer casing 30 and to cause tension on the core sling 58 so that the pulling connection 52 pulls up on the top of the core 24 as shown in FIG. 2. Also, as shown in FIG. 1, the air inlet port 82 is closed by the air inlet port shutter 84 and the exhaust port is closed in a similar manner. The air supply hose 107 is connected from the air reservoir 106 to the air supply opening 112 and the auxiliary air line 114 is connected from the air inlet port 82 to the auxiliary air inlet 116. The vent cover 80 is placed over the equalizer vent 78 and the vent plug 76 are removed from the bounce chamber 72. Also, the diesel fuel inlets are closed. As described above, the starting slot cover 96 prevents escape of air out through the starting slot 94.

The quick opening valve 110 is then opened, but the bleed valve 120 is closed. Pressurized air from the air reservoir 106 is supplied via the air supply line 107 to the air inlet port 82 and from there via the auxiliary air line 114 and the auxiliary air inlet 116 to the region under the bottom of the ram 32. The pressurized air under the ram causes the ram to rise up off the anvil 46. The ram rises rather slowly at first because the auxiliary air line 114 and the auxiliary air inlet 116 are of small diameter. However, when the lower end of the ram passes the air inlet port 84 air will be supplied directly from the larger diameter air supply line 107 through the large air inlet port 82 and the ram will rise much more rapidly. Because the casing is entirely sealed under the ram the applied air entering via the inlet port 82 will continue to force the ram upwardly in the casing. Also because the vent plugs 76 have been removed the air above the ram will be expelled out through the bounce chamber 72 and this air will not resist the upward ram movement.

The ram 32 continues its upward movement until its upper end strikes the upper anvil 62. The force of this impact is transferred through the hammer assembly down to the base adaptor 54, the core sling 58 and the pulling connector 52 to the upper end of the core 24 to drive the core upwardly with a sharp blow.

After the ram delivers its blow to the upper anvil 62 the quick opening valve 110 is closed and the bleed valve 120 is opened. The ram 32 falls back down inside the casing 30 but its downward fall is cushioned because the air under the ram can escape only via the bleed valve 120. In this manner the ram is prevented from striking a hard downward blow on the anvil 46. After the ram comes to rest on the anvil 46 the quick opening and bleed valves 110 and 120 are opened and closed respectively to cause the ram to be driven up again to deliver another upward blow against the upper anvil 62. These upward blows may be repeated as long as necessary to free the core 24 from the shell 28. Thereafter, the air supply hose 107 may be disconnected from the hammer and the core 24 may be pulled out of the shell 28 by lifting up on the suspension cable 22.

The hammer may then be switched to its normal diesel mode of operation by removing the covers from the air inlet and exhaust openings, removing the auxiliary air line 114 and closing the auxiliary air inlet, removing the vent cover 80, reinserting the vent plugs 76 and reconnecting the fuel inlet ports to the diesel fuel injector mechanism.

During bumpout operation the blows delivered by the ram 32 to the upper anvil 62 must be transmitted down to the pulling connector 52. Those upward blows, however, are too severe to be tolerated by the casing 30. In order to permit the bumpout blows to be transmitted to the pulling connector there are provided, as shown in FIG. 3, a plurality of elongated, twisted wire cable columns 130 distributed about the exterior of the hammer and connected to the head and base adaptors 66 and 54. The lower ends of the cable columns have enlargement 132 which fit into recesses in the base adaptor 54 and the upper ends of the cable column terminate in threaded connectors 134 which extend through the head adaptor 66 and which are tightened by nuts 136 on top of the head adaptor.

Also as shown in FIG. 3 the lower portion of the casing 30 is formed on the exterior thereof with cooling fins 138 to dissipate the heat of combustion of diesel fuel generated inside that part of the casing.

Figure 4:
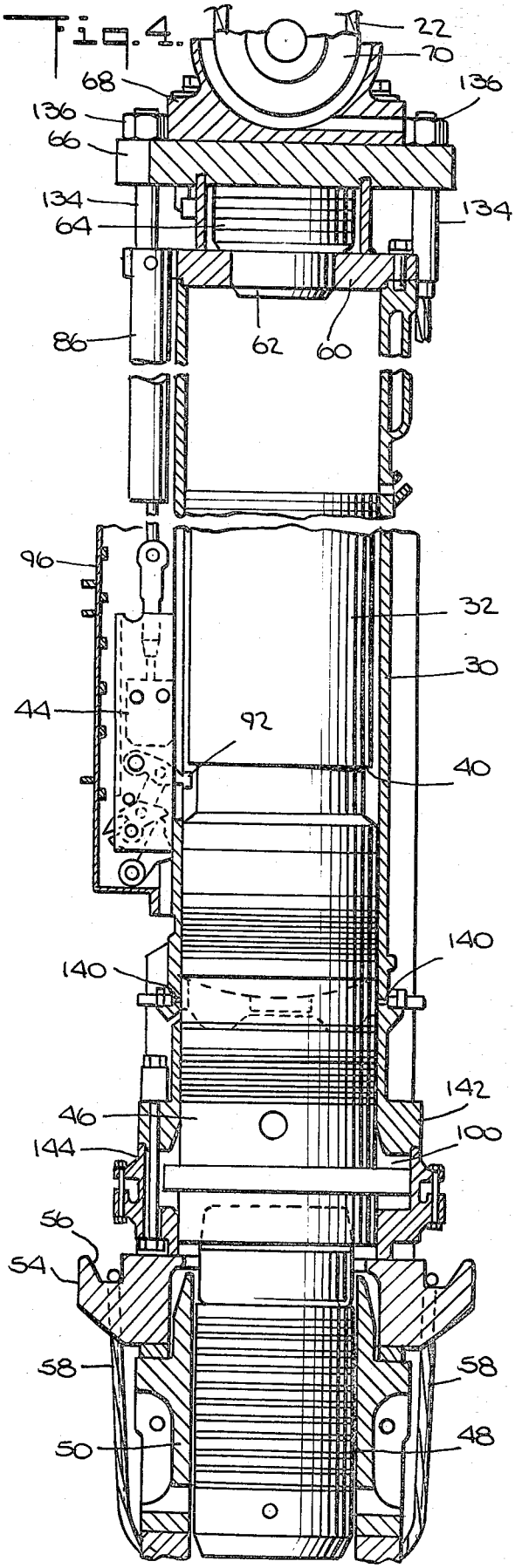
FIG. 4 is a section view taken along line 4—4 of FIG. 3.

As shown in FIG. 4, there are provided a pair of diametrically opposed fuel inlet ports 140 extending into the casing 30 at the top of the anvil 46. These inlet ports are connected to diesel fuel injectors (not shown) which supply diesel fuel in times relationship to the fall of the ram 32 in a manner well known in the art. When the hammer is modified for bumpout operation the fuel inlet ports 140 are closed.

As can also be seen in FIG. 4, the annular slot 100 is formed by a flange 142 around the bottom of the casing 30 and a collar 144 bolted to the flange. The collar in turn rests on the base adaptor 54.

Figure 5:
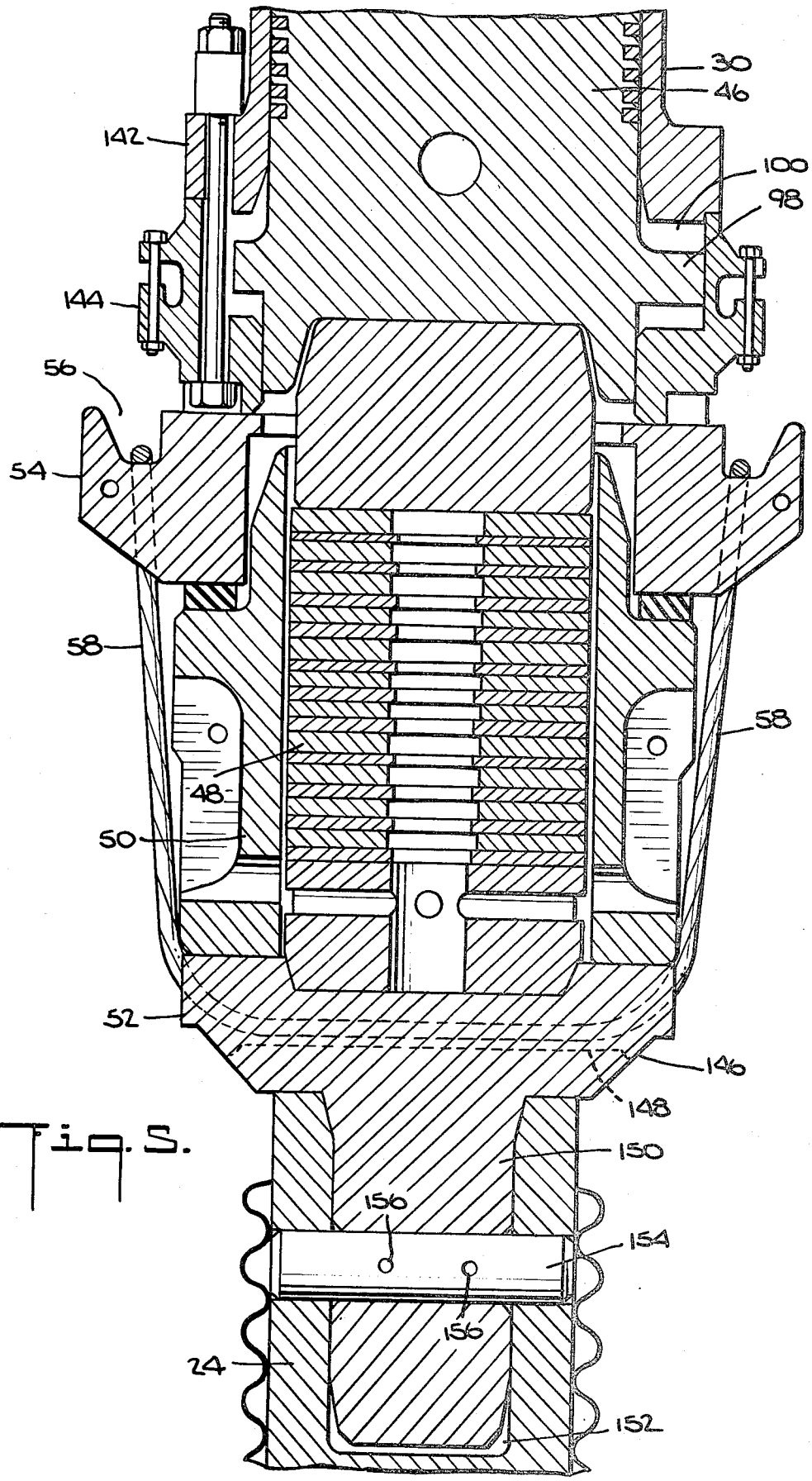
FIG. 5 is an enlarged fragmentary section view showing in detail the connection of the diesel hammer to a mandrel.

FIG. 5 shows in detail the construction of the pulling connector 52. As shown, the pulling connector comprises a disc shaped portion 146 which fits under the lower cap block casing 50. The lower end of the cap block 48 rests in the central region of the disc shaped portion 146. The disc shaped portion is formed with horizontal passageways 148 through which the core slings 58 pass. A tenon 150 extends down from the center of the disc shaped portion 146 and into a corresponding central cavity 152 in the upper end of the mandrel or core 24. A horizontal pin 154 passes diametrically through the core 24 and the tenon 150 and is locked in place by spring biased detents 156. It will be appreciated that upward forces produced by blows of the ram 32 on the upper anvil 60 and cap block 62 are transmitted through the head adaptor 66 and the cable columns 130 down to the base adaptor 54 and from there down through the core slings 58 to the pulling connector 52 and the mandrel or core 24.

Figure 6:
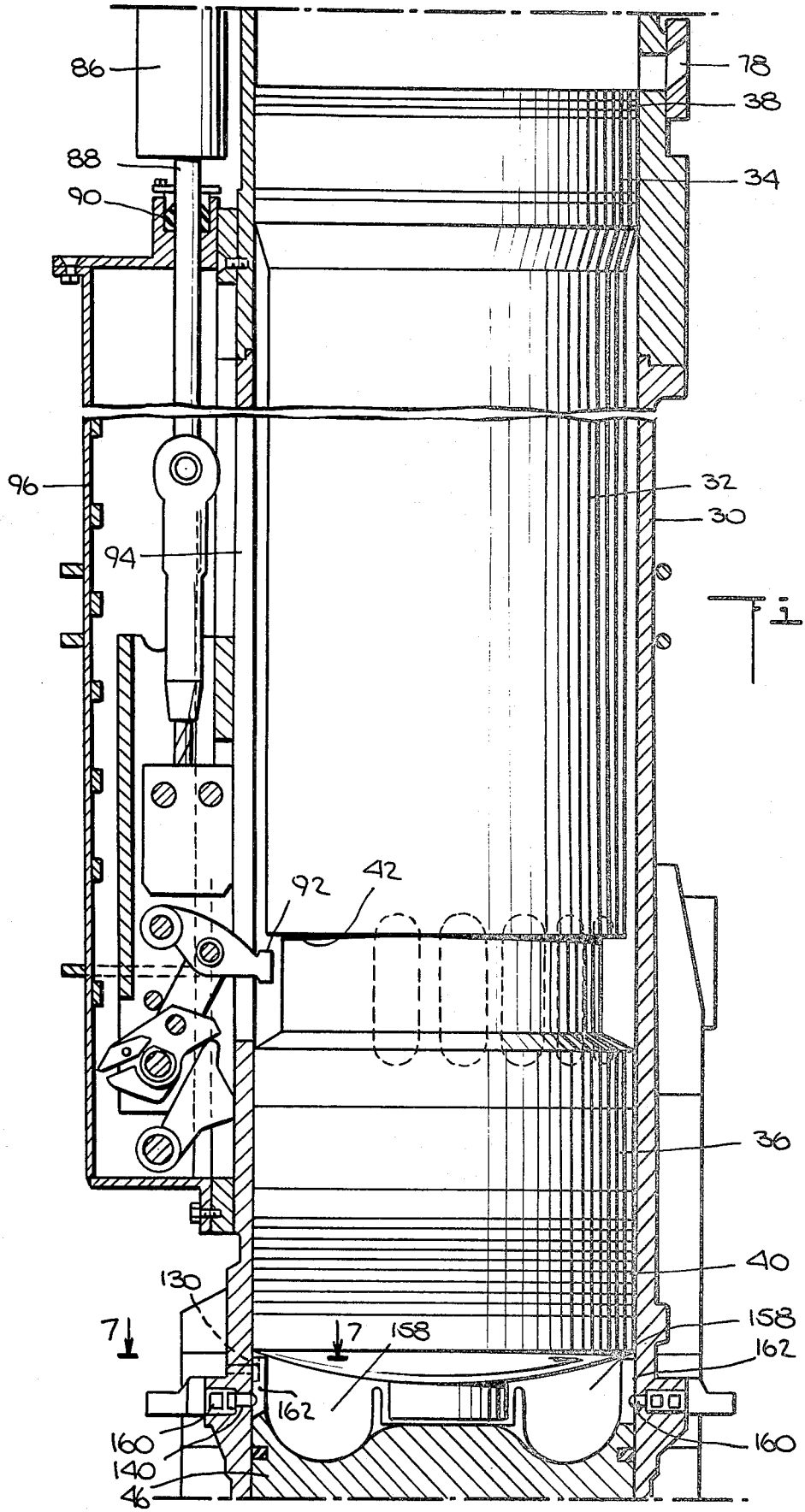
FIG. 6 is an enlarged fragmentary section view showing the ram, the anvil and the starting mechanism of the diesel hammer of FIG. 1.
Figure 7:
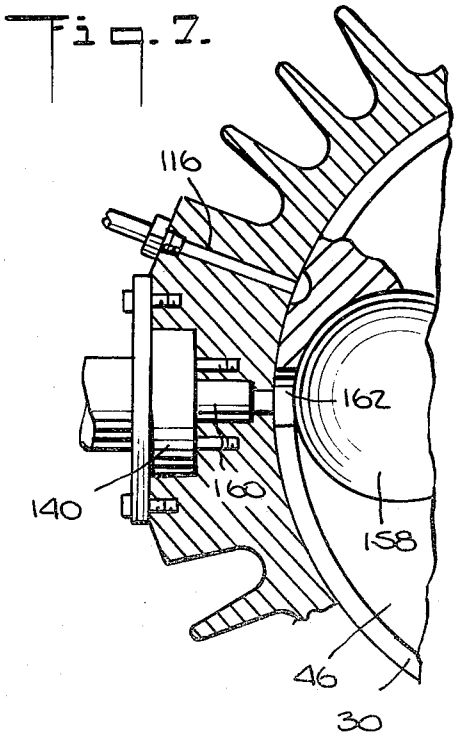
FIG. 7 is a view taken along line 7—7 of FIG. 6.

FIGS. 6 and 7 show in greater detail the configuration of the ram 32 and the anvil 46. As can be seen in these drawings the upper end of the anvil is formed with two diametrically opposed spherical cavities 158. Fuel injector nozzles 160 extend through the fuel inlet ports 140 in the walls of the casing and communicate through recesses 162 in the side of the anvil 46 to the cavities 158 so that fuel can be admitted into the compressed air in the cavities when the hammer is operating in the diesel mode. Slightly offset, circumferentially, from each nozzle 160 is the auxiliary air inlet passage 116. This passage extends through the wall of the casing 30 and opens into a vertical recess 162 in the side of the anvil. The recess 162 extends upwardly to the top of the anvil and communicates with the space between the bottom of the ram 32 and the top of the anvil.

Figure 8:
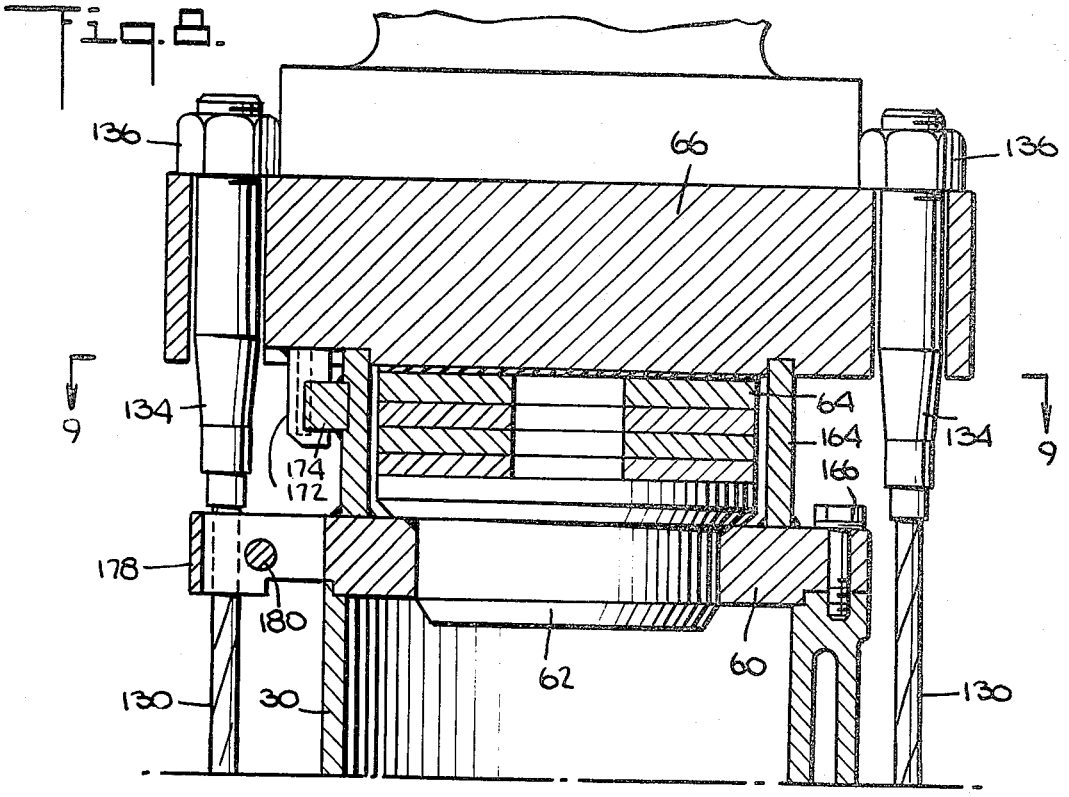
FIG. 8 is an enlarged fragmentary section view showing the upper interior portion of the diesel hammer of FIG. 1.
Figure 9:
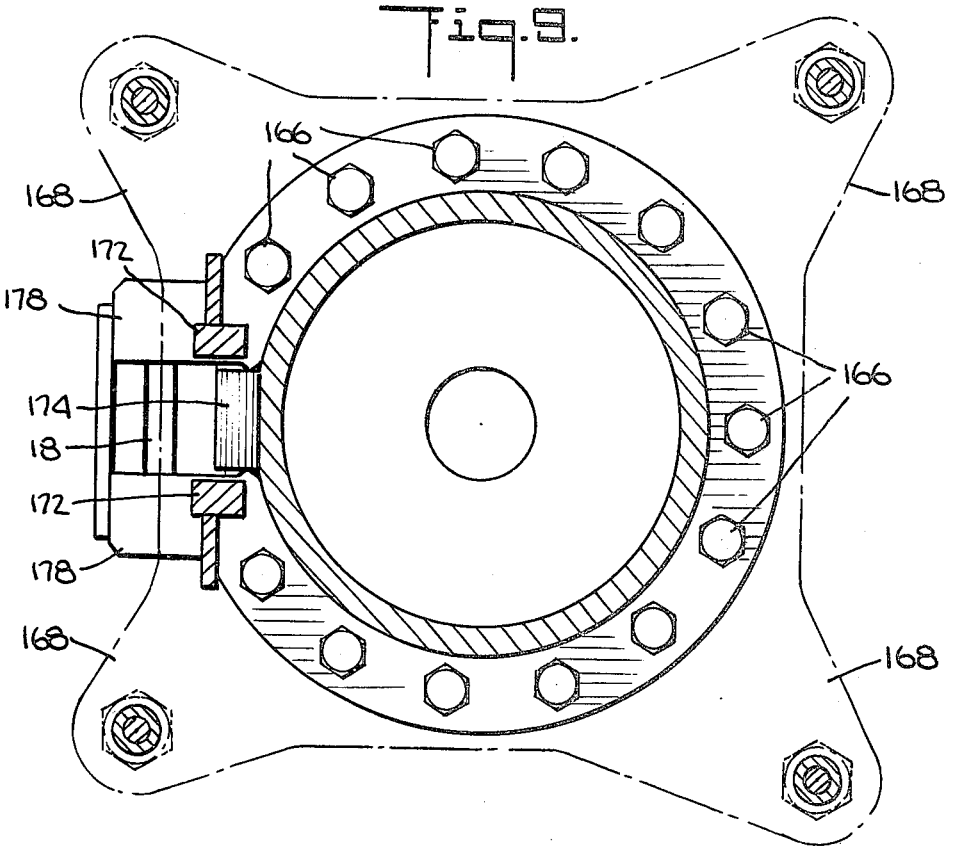
FIG. 9 is a view taken along line 9—9 of FIG. 8.

Turning now to FIG. 8, it will be seen that a cylindrical spacer 164 is welded to the upper surface of the casing cover 60 and surrounds the upper cap block 64. The cylindrical spacer 164 holds the head adaptor 66 spaced a predetermined distance above the casing cover. As shown in FIGS. 8 and 9, the casing cover 60 is held to the upper end of the casing 30 by means of a series of bolts 166.

Figure 10:
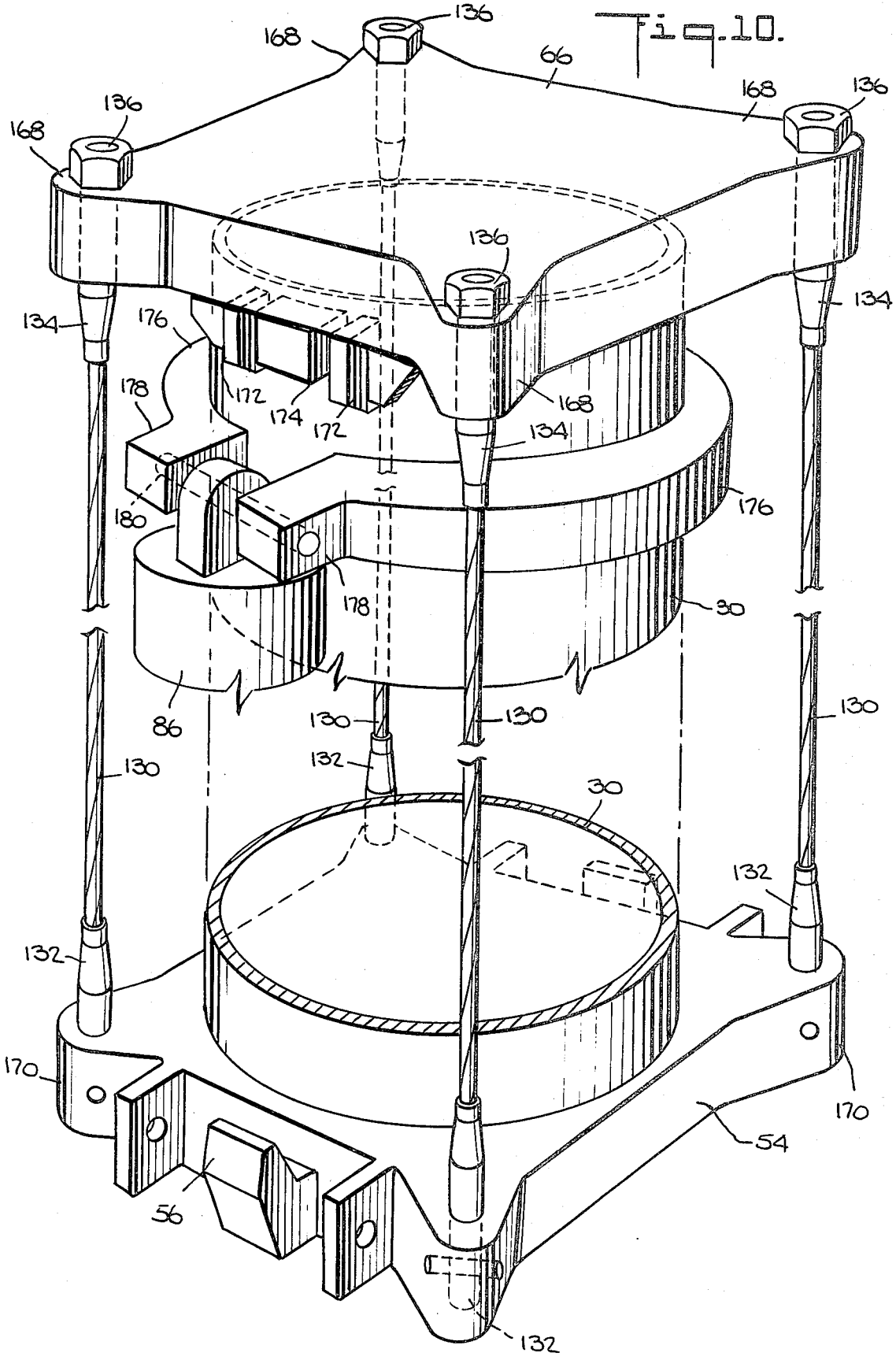
FIG. 10 is an enlarged fragmentary perspective view showing head and base adaptors and cable columns used in the diesel hammer of FIG. 1.

FIGS. 8, 9 and 10 show the structural arrangement of the hammer casting 30 and the head and base adaptors 66 and 54 and the cable columns 130. As can be seen in FIG. 10 the cable columns 130 extend between corresponding projections 168 and 170 on the head and base adaptors 66 and 54. The cable columns are under tension and they cause the head and base adaptors to press axially on the hammer casing 30. A pair of stops 172 are welded to and extend down from the head adaptor 66 on either side of a lug 174 which is welded to the hammer casing 30. This arrangement keeps the hammer casing from shifting rotationally relative to the cable head and base adaptors during operatiol of the hammer.

As shown in FIG. 10, a collar 176 extends around the casing 30 near its upper end. this collar has two spaced apart projections 178 at its ends through which a pin 180 extends. The pin supports the upper end of the starter piston and cylinder 86.

Figure 11:
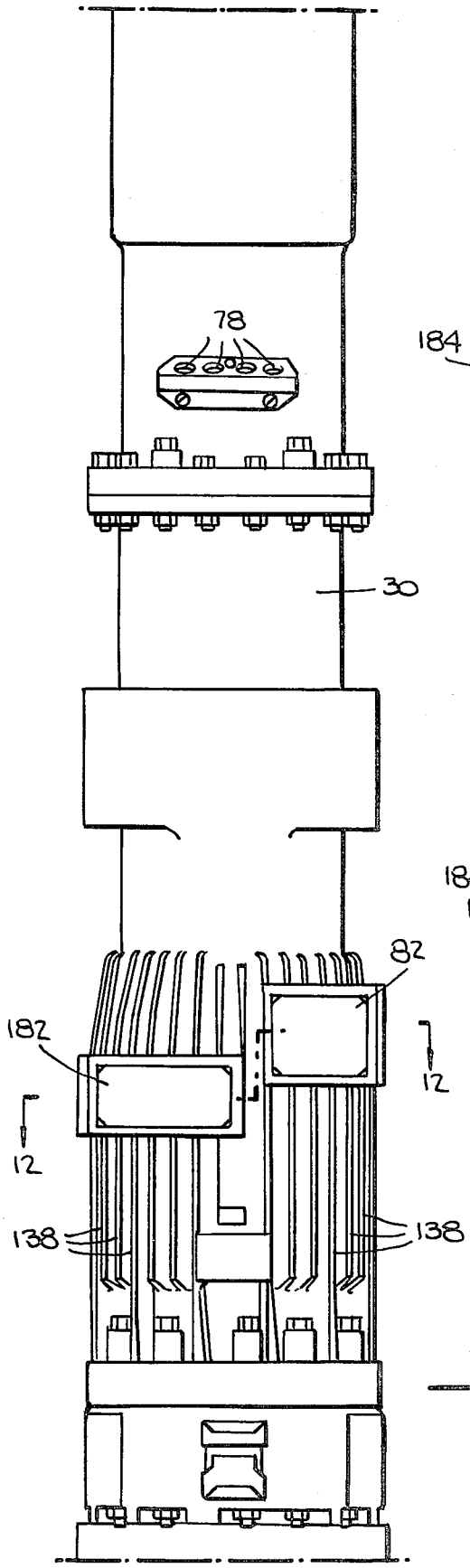
FIG. 11 is an elevational view showing the exterior of the lower portion of the diesel hammer of FIG. 1.
Figure 13:
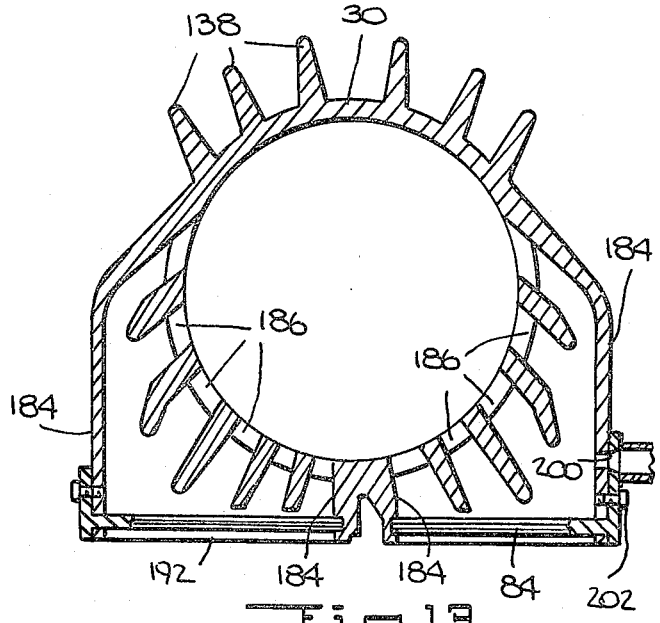
FIG. 13 is a view similar to FIG. 12 but showing the closure of the diesel hammer air intake and exhaust ports when the hammer is adapted for bumpout operation according to the invention.
Figure 12:
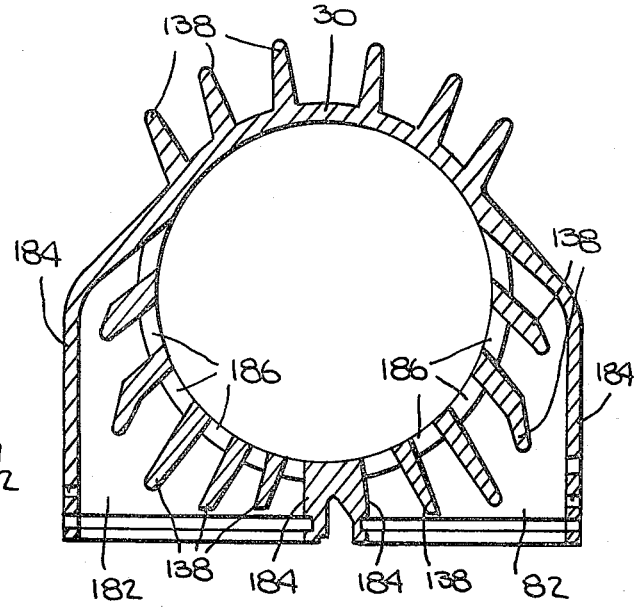
FIG. 12 is a view taken along line 12—12 of FIG. 11.

FIGS. 11, 12 and 13 show the hammer inlet and exhaust arrangement and the manner in which it is sealed for bumpout operation. As can be seen in FIG. 11 the air inlet port 82 is located amid the cooling fins 138. An exhaust port 182 is also provided. This port is offset circumferentially from, and is a little lower on the casing then, the inlet port 82. As shown in FIG. 12 the air inlet and exhaust ports 82 and 182 have ducts formed by walls 184 extending out from the hammer casing 30. The ducts communicate with the interior of the casing via spaces 186 between the cooling fins 138.

Slots 188 are formed in the walls 184 near their outer ends to permit insertion of shutters for sealing the ports during bumpout operation. There is also provided an opening 112 in one of the walls 184 for connection of a supply line when the hammer is used for bumpout operation.

When the hammer operates in its direct mode to hammer down on a pile or a core, the inlet and exhaust ports 82 and 182 are left open as shown in FIG. 12. when the hammer is converted to bumpout operation, the ports are covered as shown in FIG. 13. As can be seen the air inlet port shutter 84 covers the air inlet port 82 and an exhaust port shutter 192 covers the exhaust port 182.

FIGS. 14, 15 and 16 show the construction of the inlet port shutter 84 and the manner of attaching to the hammer assembly to cover the inlet port 82. As can be seen the shutter 84 is formed with a flat rectangular plate 194 which fits into the slot 188. The port 82 is formed with a groove 196 around its edges and the plate slides along the groove when it is inserted into the slot. As shown in FIG. 16, a rubber seal 198 is provided around the groove to seal the port 82 when the shutter is in place. A flange 200 is attached to the outer edge of the plate 196 and lies against the wall 184 when the plate is in place covering the port 82, as shown in FIG. 15. The shutter is held in place by screws 202 which extend through the flange 200 and into the wall 184.

The shutters 84 and 192 are of essentially the same construction except that the flange 200 of the air inlet shutter 84 is formed with the air inlet opening 112 for connecting to the air inlet line 107 as well as a further opening 204 for connecting to the auxiliary air line 114.

FIGS. 17, 18 and 19 illustrate the construction of the starting slot cover 96 which seals the starting slot 94 to retain pressure inside the hammer casing 30 during bumpout operation. As can be seen, the cover 96 comprises an elongated channel shaped member 208 welded along its edges to solid flange plates 210.

As shown in FIG. 19 these flange plates are bolted by means of bolts 212 to bosses 214 on the hammer casing 30 along opposite edges of the starting slot 94. Horizontal reinforcing plates 216 are welded to the outside of the channel shaped member and to the flange plates 210. These reinforcing plates are positioned at various locations along the length of the slot 94. Reinforcing bands 218 extend around the hammer casing 30 and the ends of these band extend through grommets 220 formed in the flange plates 210. The ends of the bands are threaded and the bands are tightened around the hammer casing and are secured to the flange plates 210 by means of nuts 222 as shown in FIGS. 18 and 19. Upper and lower covers 224 and 226 are secured to the ends of the channel shaped member 208 and the packing gland 90 is mounted in the upper cover 224. This arrangement serves to hold the hammer casing against spreading in the region of the starting slot 94 when that region is subjected to air pressure during bumpout operation. It will be understood that the slot sealing and reinforcing arrangements may be dispensed with in hammers which do not use a starting slot.

Figure 21:
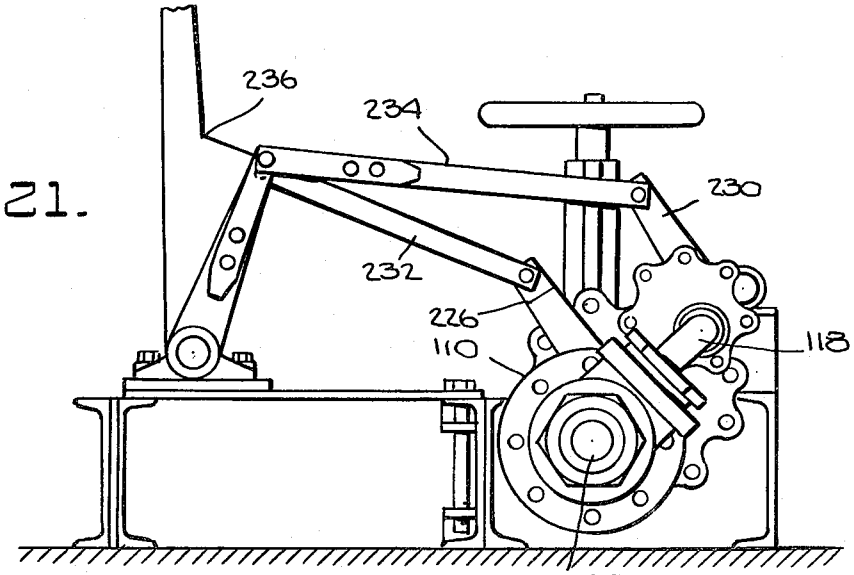
FIG. 21 is a view taken along line 21—21 of FIG. 20.
Figure 20:
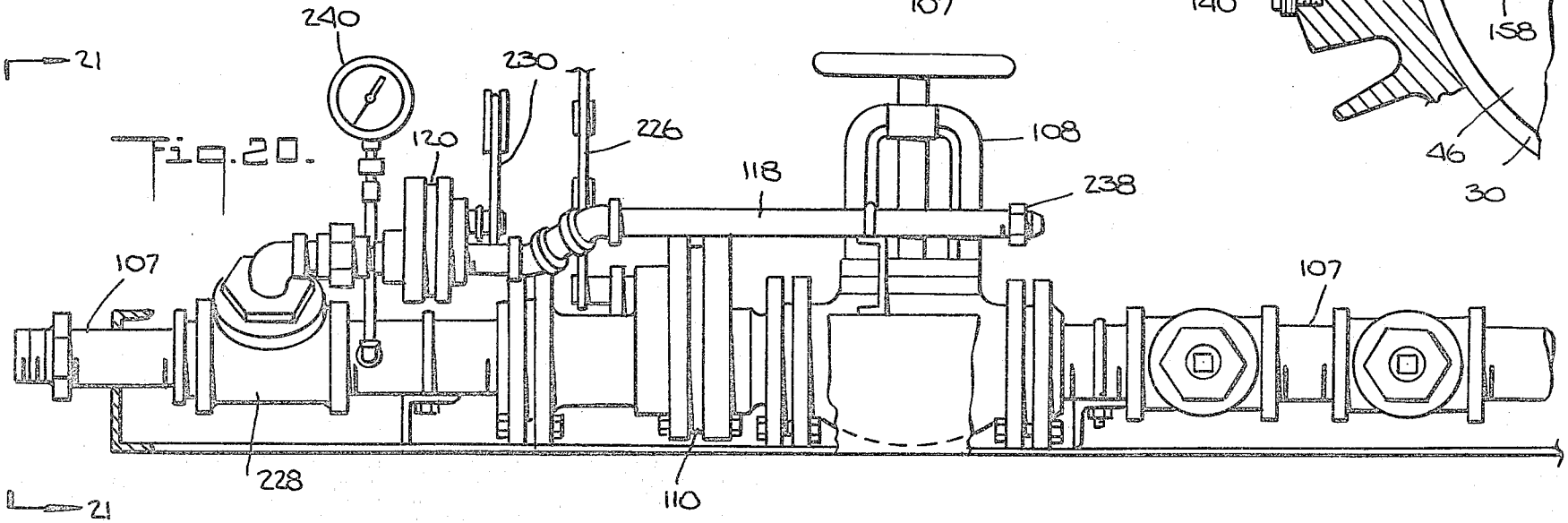
FIG. 20 is a side elevational view of air supply and bleed lines and valves used in the hammer arrangement of FIG. 1.

FIGS. 20 and 21 show in greater detail the air supply and cushioning arrangement used for bumpout operation. The air line 107 extends from the air reservoir 106 (FIG. 1) to the pressure reducing valve 108 which is a standard globe valve used to adjust the bumpout pressure to a level suitable to raise the ram at a predetermined rate. In the case of the ram of the ICE Model 520 Diesel Pile Hammer, in which the ram weights 5070 pounds (2,300 kg.) and has a diameter of 18 inches (45 cm.) and a stroke for bumpout operation of about 50 inches (1.25 meters), it is preferred that air supplied through the gate valve 108 be at a pressure of about 125 psig (8.8 kg. per cm.$^2$) and that the air supply line 107 have a diameter of two inches (5 cm.). Approximately 50 cubic feet (1.4 cubic meters) per minute of air compressed to 125 psig (8.8 kg. per cm.$^2$) is used for each uplift blow and a compressor of 50 cubic feet (1.4 cubic meters) per minute capacity driven by a 7.5 horsepower motor will produce about one uplift blow per minute. Of course, a larger compressor may be used to deliver uplift blows at a higher rate.

The quick opening valve 110 is arranged in the air supply line 107 between the pressure reducing valve 108 and the air inlet port 82 of the hammer assembly. The quick opening valve 110 is preferably a sliding disc type valve such as the single disc valves supplied by Everlasting Valve Company, 20 Myrtle St., Cranford, N.J. This valve has a shutter (not shown) which slides into and out of the fluid flow line 107 by movement of a wrench arm 226.

A tee connection 228 is provided in the air supply line 107 between the quick opening valve 110 and the air inlet port 82 of the hammer assembly. The tee connection is connected to the bleed line 118 and through that line to the bleed valve 120. The bleed valve 120 is also a quick opening valve and may be of the same type as the air inlet quick opening valve 110. The bleed valved 120 also operates by movement of a wrench arm 230. As can be seen in FIG. 21, link arms 232 and 234 are connected between a bell crank lever 236 and each of the wrench arms 226 and 230 of the air inlet and bleed valves 110 and 120. When the bell crank lever 236 is moved in one direction the air inlet quick opening valve 110 is opened and the bleed valve 120 is closed. When the lever 236 is moved in the opposite direction the air inlet quick opening valve is closed out the bleed valve 120 is opened. The bleed line 118 extends to an adjustable orifice 238 which exhausts to the atmosphere.

The bumpout operation is controlled by the bell crank lever 236. After the inlet and exhaust ports 82 and 182 and the equalizer vent 78 are closed, the bounce chamber vents 76 are opened and the air lines are connected, the bell crank lever 236 is operated to open the air inlet quick opening valve 110 and to close the bleed valve 120. Air from the reservoir 106 will flow through the air supply line 107 into the air inlet port 82 and throught the auxiliary air line 114 to the auxiliary air inlet 116 under the hammer ram 32 to lift the ram in the casing 30. The ram is thrown upwardly by this pressurized air until it strikes the upper anvil 62 to deliver an uplift blow. At this time the bell crank lever 236 is reversed to close the air inlet quick opening valve 110 and to open the bleed valve 120. The ram then drops back down in the casing 30 and forces the air under it out through the bleed line 118. The rate at which the ram falls depends on the rate at which air can escape via the bleed line 118 and this in turn is controlled by the setting of the adjustrable orifice 238. It will be appreciated that by setting the adjustable orifice the ram may be made to fall slowly in the casing so that it does not deliver a downward blow on the lower anvil 46 after each uplift blow produced on the upper anvil 62. A pressure gauge 240 may be placed in the air supply line 107 between the air inlet quick opening valve 110 and the hammer assembly to monitor the operating pressure during the raising and lowering of the ram during bumpout operation.

We claim:

1. In a diesel hammer which comprises a cylindrical casing, a ram fitted to move up and down in said casing, an anvil at the lower end of said casing to receive blows from said ram, inlet and exhaust ports formed in said casing to admit air to be compressed by the downward movement of said ram and to allow combustion gases to be expelled when said ram is raised and a fuel injection mechanism for admitting diesel fuel into the region under said ram when said ram compresses air thereunder and impacts said anvil, said inlet and exhaust ports and said fuel injection mechanism being arranged to cooperate with each other to provide diesel operation in the delivery of downward blows against said anvil, the improvement which comprises structural means to cause said hammer to operate in a non-diesel manner for delivery of uplift blows to said casing to extract an element from the ground, said structural means comprising, an upper anvil in the upper end of said casing above the height to which said ram is thrown during diesel operation, a vent valve connected to the upper end of said casing to vent same and permit unrestricted upward movement of said ram during non-diesel operation, ram drive means connected to said casing and arranged to throw said ram upwardly in said casing, independently of said diesel operation, to a height sufficient to impact against said upper anvil, closures arranged to close said inlet and exhaust ports, valve means connected to the lower part of said casing to permit limited escape of gas therefrom, said closures and valve means cooperating when said hammer operates in a non-diesel manner to entrap and slowly release gases under said ram and cushion against heavy impacts against said lower anvil and a pulling connection attached to said casing for connecting said casing to a member which is to receive uplift blows.

2. The diesel hammer arrangement of claim 1 wherein the means to throw said ram upwardly in the casing comprises means for applying pressurized gas to the region of said casing under said ram sufficient to force said ram up in the casing to strike against said upper anvil and means closing said casing in the region under the upwardly forced ram to prevent leakage of gases out from said casing during upward movement of said ram.

3. The diesel hammer arrangement of claim 2 wherein said menas for applying pressurized gas to the region of said casing under said ram comprises a source of compressed air, an air supply line extending from said source of compressed air to said casing under said ram and an air inlet valve in said air supply line to control the flow of air to said casing.

4. The diesel hammer arrangement of claim 3 wherein said air supply line is connected to the air inlet port of said casing.

5. The diesel hammer arrangement of claim 4 wherein an auxiliary air supply line extends from said air supply line to said casing under said ram when it rests on the anvil at the lower end of said casing.

6. The diesel hammer arrangement of claim 2 wherein said closures comprise removeable shutters connectable to the inlet and exhaust ports of said hammer casing.

7. The diesel hammer arrangement of claim 1 wherein said vent valve at the upper end of the casing comprises a removeable plug arranged in a bounce chamber communicating with the upper end of said casing.

8. The diesel hammer arrangement of claim 1 wherein said cushion forming construction comprises a bleed line connected to said air supply line between said air inlet valve and said casing.

9. The diesel hammer arrangement of claim 8 wherein a bleed valve is arranged in said bleed line.

10. The diesel hammer arrangement of claim 9 wherein said bleed valve and said air inlet valve are interconnected so that said air inlet line is open when said bleed line is closed and vice versa.

11. The diesel hammer arrangement of claim 8 wherein said bleed line has an adjustable orifice therein.

12. In a diesel hammer which comprises a cylindrical casing, a ram fitted to move up and down in said casing, an anvil at the lower end of said casing to receive blows from said ram, inlet and exhaust ports formed in said casing to admit air to be compressed by the downward movement of said ram and to allow combustion gases to be expelled when said ram is raised and a fuel injection mechanism for admitting diesel fuel into the region under said ram when said ram compresses air thereunder and impacts said anvil, said inlet and exhaust ports and said fuel injection mechanism being arranged to cooperate with each other to provide diesel operation in the delivery of downward blows against said anvil, the improvement which comprises structural means to cause said hammer to operate in a non-diesel manner for delivery of uplift blows to said casing to extract an element from the ground, said structural means comprising an upper anvil in the upper end of casing above the height to which said ram is thrown during diesel operation, a vent valve connected to the upper end of said casing to vent same and permit unrestricted upward movement of said ram during non-diesel operations, a source of a compressed gas, means for delivering said compressed gas from said source to the region in said casing under said ram to throw said ram upwardly in the casing, independently of said diesel operation, to a height sufficient to strike against said upper anvil, closures arranged to close said inlet and exhaust ports and valve means connected to the lower part of said casing to permit limited escape of air therefrom, said closures and valve means cooperating, when said hammer operates in a non-diesel manner, to entrap and slowly release air from under said ran and cushion same against heavy impacts against said lower anvil and a pulling connection attached to said casing for connecting said casing to a member which is to receive uplift blows.

13. A method of using a diesel hammer of the type which normally delivers downward blows, to deliver uplift blows in a non-diesel mode of operation, said method comprising the steps of discontinuing the diesel operation of the hammer, connecting the casing of said hammer to an object which is to receive uplift blows, venting the top of the hammer casing to permit free upward movement of its ram, sealing all other openings in said casing, applying a presurized gas under the ram in said casing to drive the ram upwardly in the casing independently of diesel operation and to a height beyond that to which the ram is driven in diesel operation to cause the ram to strike against an anvil at the top of the casing and thereafter cushioning the subsequent fall of the ram by permitting the gas under the ram to escape from the casing at a controlled rate.

14. A method according to claim 13 wherein the gas is compressed air.

15. A method according to claim 14 wherein the air is applied to the casing via an air line from an external compressed air source.

16. A method according to claim 15 wherein air is flowed from said source through said air line to drive the ram upwardly and wherein the fall of the ram downwardly is cushioned by directing the air through a bleed line connected to said casing.

* * * * *

UNITED STATES PATENT AND TRADEMARK OFFICE

CERTIFICATE OF CORRECTION

PATENT NO. : 4,473,123

DATED : September 25, 1984

INVENTOR(S) : Eberhard V. Ranft and Robert L. Vincent

It is certified that error appears in the above-identified patent and that said Letters Patent is hereby corrected as shown below:

Column 4, line 10, "if" to read -- is --;

Column 6, line 6, "94" to read -- 96 --;

Column 9, line 24, "operatiol" to read -- operation --;

Column 11, line 22, "throught" to read -- through --;

Column 12, line 21, "menas" to read -- means --;

Column 13, line 17, "ran" to read -- ram --.

Signed and Sealed this

*Twenty-sixth* Day of *March 1985*

[SEAL]

*Attest:*

DONALD J. QUIGG

*Attesting Officer* *Acting Commissioner of Patents and Trademarks*